US007832831B2

(12) United States Patent
Uchiyama et al.

(10) Patent No.: US 7,832,831 B2
(45) Date of Patent: Nov. 16, 2010

(54) METHOD FOR CONTROLLING LIQUID EJECTION APPARATUS AND LIQUID EJECTION APPARATUS

(75) Inventors: Masaki Uchiyama, Azumino (JP); Takeo Seino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 919 days.

(21) Appl. No.: 11/712,681

(22) Filed: Feb. 28, 2007

(65) Prior Publication Data

US 2007/0222843 A1 Sep. 27, 2007

(30) Foreign Application Priority Data

Feb. 28, 2006 (JP) ..... 2006-053239

(51) Int. Cl.
*B41J 2/165* (2006.01)
*B41J 2/19* (2006.01)
*B41J 2/175* (2006.01)

(52) U.S. Cl. ..... 347/30; 347/5; 347/6; 347/20; 347/22; 347/24; 347/25; 347/29; 347/32; 347/92; 347/93

(58) Field of Classification Search ..... 347/30, 347/32

See application file for complete search history.

(56) References Cited

U.S. PATENT DOCUMENTS

| | | | | |
|---|---|---|---|---|
| 4,631,556 | A * | 12/1986 | Watanabe et al. | 347/30 |
| 4,893,138 | A * | 1/1990 | Terasawa et al. | 347/30 |
| 5,689,293 | A * | 11/1997 | Hirano | 347/33 |
| 6,527,361 | B1 * | 3/2003 | Gotoh et al. | 347/30 |
| 7,159,961 | B2 * | 1/2007 | Nozawa et al. | 347/29 |
| 7,204,575 | B2 * | 4/2007 | Sakurai | 347/23 |
| 7,240,984 | B2 * | 7/2007 | Kayanaka | 347/23 |
| 2002/0060713 | A1 * | 5/2002 | Katakura et al. | 347/30 |
| 2003/0227506 | A1 * | 12/2003 | Nozawa et al. | 347/30 |
| 2004/0141023 | A1 * | 7/2004 | Nakamura | 347/30 |
| 2006/0066697 | A1 * | 3/2006 | Inoue | 347/89 |
| 2006/0176346 | A1 * | 8/2006 | Momose | 347/85 |
| 2006/0214982 | A1 * | 9/2006 | Yamamoto et al. | 347/30 |

FOREIGN PATENT DOCUMENTS

| | | |
|---|---|---|
| JP | 2000-127455 A | 5/2000 |
| JP | 2001-001554 | 1/2001 |
| JP | 2001-001554 A | 1/2001 |
| JP | 2004-058398 A | 2/2004 |
| JP | 2004-188410 A | 7/2004 |

* cited by examiner

*Primary Examiner*—Ryan Lepisto
(74) *Attorney, Agent, or Firm*—Nutter McClennen & Fish LLP; John J. Penny, V

(57) ABSTRACT

A printer includes a recording head having a nozzle that ejects ink and a suction pump that draws the ink through the nozzle. A valve unit and a filter are arranged in a passage that supplies the ink to the recording head. A controller of the printer operates the suction pump to perform suction/suspension in which suction of the ink from the passage through the nozzle and suspension of the suction are alternately repeated with the valve unit maintained in a closed state, thus promoting joining of bubbles on the filter. The controller then operates to open the valve unit to drain the joint bubbles from the filter, together with the ink, using negative pressure accumulated in the passage.

14 Claims, 6 Drawing Sheets

1
1a
RAM
31
ROM
32
Timer
33
ASIC
34
CPU
30
35
Third Motor Driver Circuit
38
Valve Driver Circuit
40
Maintenance Motor
M3
Suction Pump
25
Transmission Mechanism
22
Actuator
16a
First Motor Driver Circuit
36
Second Motor Driver Circuit
37
Head Driver Circuit
39
Paper Feeder Motor
M1
Carriage Motor
M2
Recording Head
5
Paper Feeder Mechanism
4
Carriage
6

METHOD FOR CONTROLLING LIQUID EJECTION APPARATUS AND LIQUID EJECTION APPARATUS

CROSS-REFERENCE TO RELATED APPLICATION

This application is based upon and claims the benefit of priority from prior Japanese Patent Application No. 2006-053239, filed on Feb. 28, 2006, the entire content of which is incorporated herein by reference.

BACKGROUND

1. Technical Field

The present invention relates to a method for controlling a liquid ejection apparatus and a liquid ejection apparatus.

2. Background Art

As a liquid ejection apparatus that ejects liquid from a liquid ejection head to a target, an inkjet type printer (hereinafter, referred to as a printer) is known. The printer supplies ink from a cartridge, which retains ink as liquid, to a recording head, or a liquid ejection head, mounted in a carriage. The recording head is then operated to eject the ink onto a sheet of paper, or a target, through nozzles of the recording head.

The printer typically includes a maintenance mechanism. The maintenance mechanism wipes and cleans a nozzle forming surface of the recording head, caps the recording head for preventing the ink from drying in the nozzles, and draws and drains dust and bubbles from the recording head.

A printer described in Japanese Laid-Open Patent Publication No. 2001-1554 includes a valve arranged in an ink passage extending between a cartridge and a recording head. The valve is used in choke cleaning. In the choke cleaning, the valve is closed and a pump is actuated to draw and drain ink from the recording head. This rapidly lowers the pressure in the portion of the passage from the valve to the recording head.

As a result, referring to FIG. 7, negative pressure accumulates in the recording head from the point of time at which suction starts to time TA. At the time TA, the pump is stopped and held in the stopped state until time TB, in such a manner that small bubbles generated by the negative pressure are joined together. At the time TB, the valve is opened to cause a rapid ink flow into the passage, in which the negative pressure has accumulated, instantly increasing the flow speed of the ink. As a result, together with the ink flowing at the increased speed, bubbles and undesirable objects are discharged from the recording head through the nozzles.

Nonetheless, the choke cleaning may cause small bubbles to be caught by a filter arranged between the valve and the recording head. Particularly, if a complicatedly configured recording head or easily foaming ink is employed, the bubbles are easily caught by the filter.

In this case, if the pump is maintained in the stopped state from the time TA to the time TB, joining of the bubbles caught by the filter is not sufficiently promoted. The ink is thus drained through the bubbles on the filter. Also, the bubbles caught by the filter lower the ink supply performance of the recording head or cause flow of bubbles from the nozzles when printing is performed, thus degrading the printing quality.

SUMMARY

Accordingly, it is an objective of the present invention to provide a method for controlling a liquid ejection apparatus and a liquid ejection apparatus that improve bubble drainage performance.

In accordance with one aspect of the present invention, a control method of a liquid ejection apparatus having a liquid ejection head that ejects a liquid from a nozzle is provided. A valve mechanism and a filter are arranged in a liquid passage connected to the liquid ejection head. The filter is provided between the valve mechanism and the liquid ejection head. The method includes: performing a suction/suspension in which, with the valve mechanism maintained in a closed state, suction of the liquid from the passage through the nozzle and suspension of the suction are alternately repeated, whereby accumulating a negative pressure in the passage at a side downstream from the valve mechanism; and performing a drainage in which the valve mechanism is opened so that, using the negative pressure accumulated in the passage, bubbles are removed from the filter through the nozzle together with the liquid.

In accordance with a second aspect of the present invention, a liquid ejection apparatus is provided. The apparatus includes a liquid ejection head that ejects a liquid through a nozzle, a liquid passage connected to the liquid ejection head for supplying the liquid to the liquid ejection head, a valve mechanism arranged in the liquid passage, a filter provided in the liquid passage and between the valve mechanism and the liquid ejection head, a suction unit that draws the liquid from the nozzle, and a suction control unit that controls operations of the valve mechanism and the suction unit. The suction control unit operates the suction unit to perform suction/suspension in which suction of the liquid from the passage through the nozzle and suspension of the suction are alternately repeated with the valve mechanism held in a closed state, whereby accumulating a negative pressure in the passage at a side downstream from the valve mechanism. The suction control unit operates to open the valve mechanism after the suction/suspension, whereby performing, using the negative pressure accumulated in the passage, a drainage in which bubbles are removed from the filter through the nozzle together with the liquid.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DESCRIPTION OF EXEMPLARY EMBODIMENTS

An embodiment of the present invention will now be described with reference to FIGS. 1 to 6.

Figure 1:
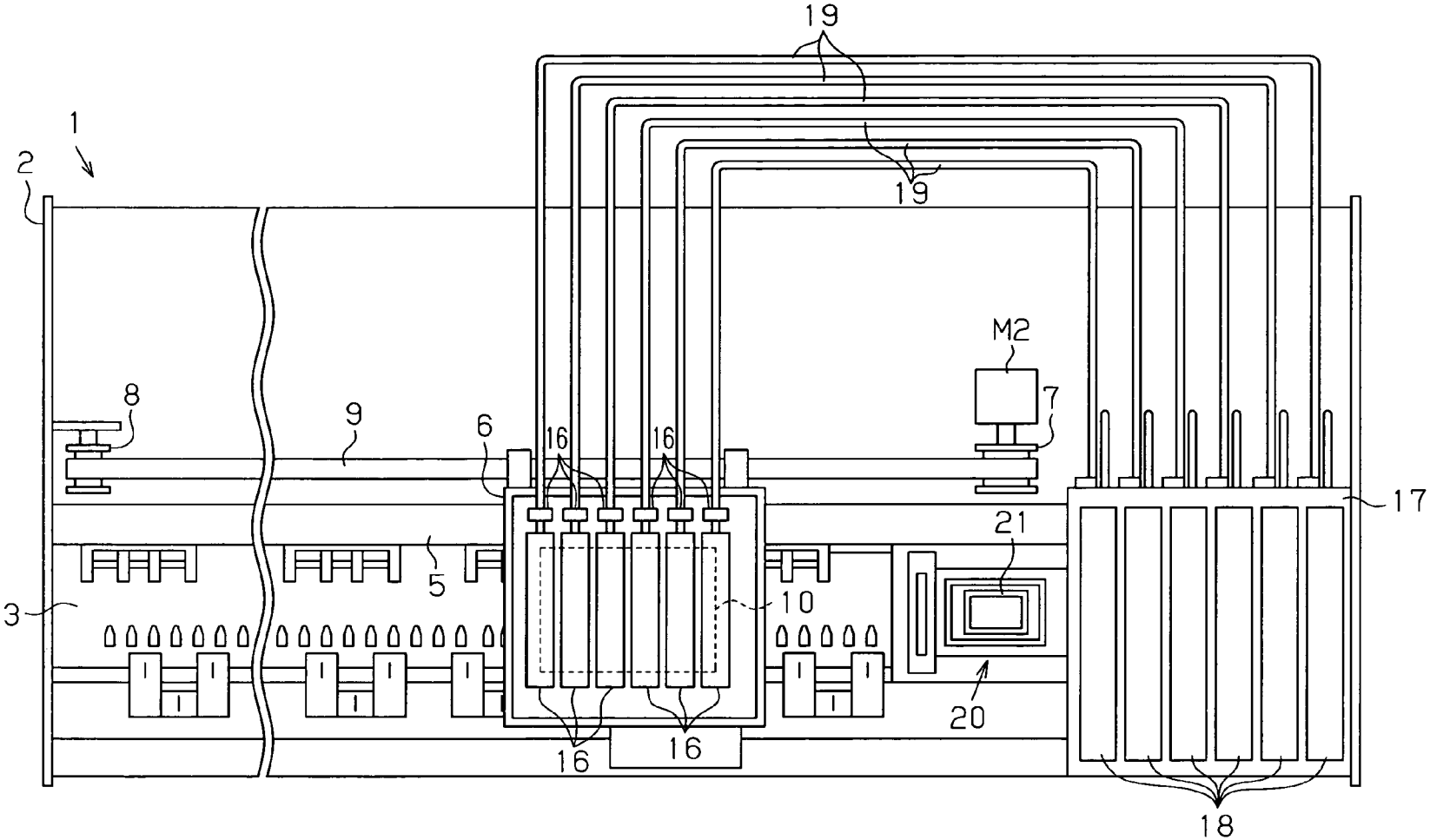
FIG. 1 is a plan view showing an inkjet type printer according to the present invention.

As shown in FIG. 1, a printer 1, or a liquid ejection apparatus, has a frame 2 shaped substantially as a rectangular parallelepiped. A platen 3, which extends in the longitudinal direction of the frame 2, is supported by the platen 3. A paper feeder motor Ml and a paper feeder mechanism 4 (see FIG. 3) supply a sheet of printing paper to the platen 3. A bar-like guide member 5 extending parallel with the longitudinal direction of the platen 3 is provided in the frame 2. A carriage 6 movable along the guide member 5 is supported by the guide member 5. The carriage 6 reciprocates along the guide members 5.

A carriage motor M2 is provided in the frame 2 and a drive pulley 7 is secured to the carriage motor M2. A driven pulley 8 is secured to the frame 2. A timing belt 9 is wound around the drive pulley 7 and the driven pulley 8. The carriage 6 is operationally connected to the carriage motor M2 through the timing belt 9. The carriage 6 is thus driven by the carriage motor M2 to reciprocate along the guide member 5.

Figure 2:
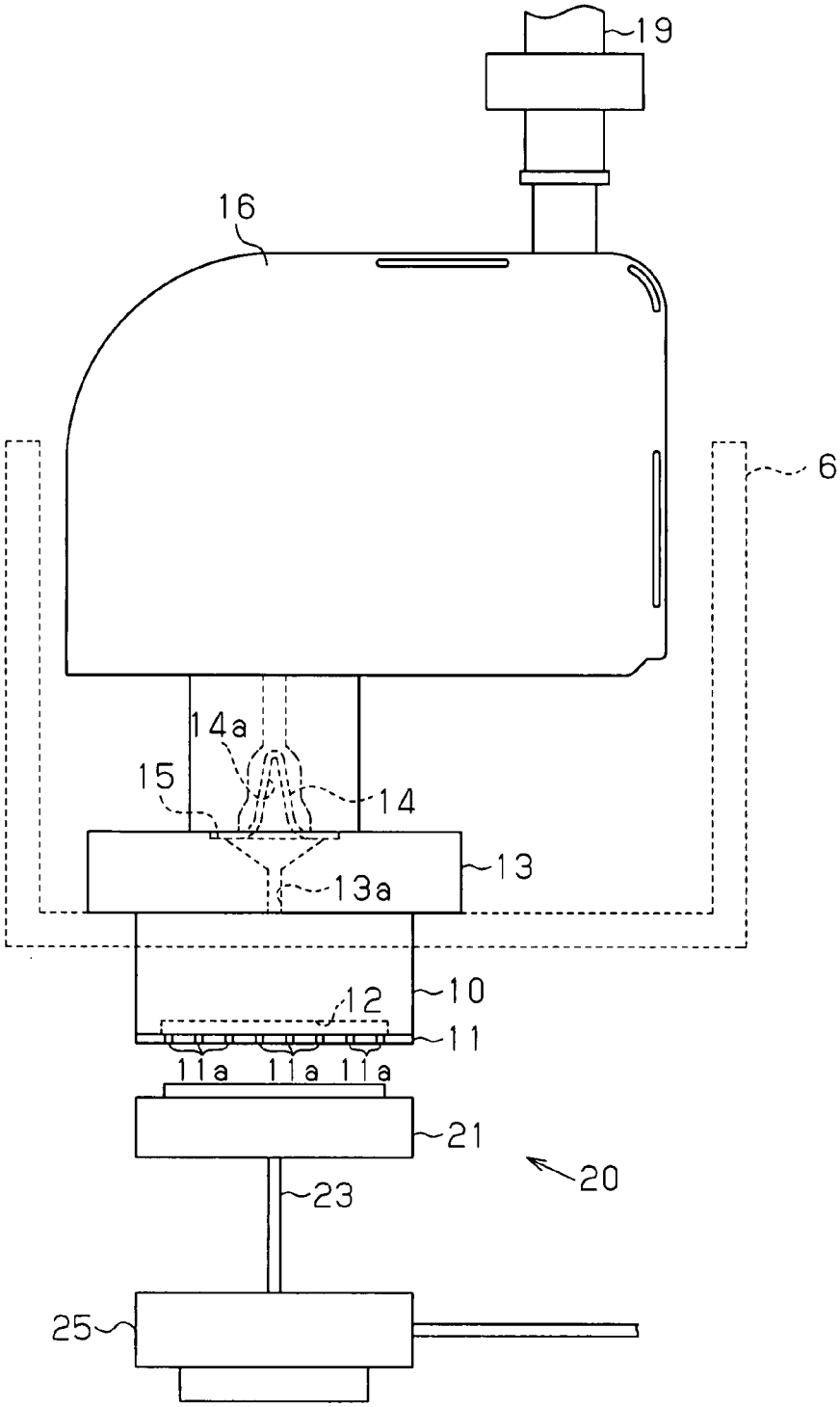
FIG. 2 is a view for explaining choke cleaning of the printer of FIG. 1.

As shown in FIG. 2, a recording head 10, or a liquid ejection head, is secured to the bottom surface of the carriage 6. A nozzle plate 11 is provided at the surface of the recording head 10 opposed to the platen 3. Nozzle rows are defined in the nozzle plate 11. The number of the nozzle rows correspond to the number of the types of ink (liquid) used by the printer 1. In the illustrated embodiment, six colors of ink are used by the printer 1. Therefore, six nozzle rows are provided in the nozzle plate 11. Each of the nozzle rows is defined by a plurality of nozzles 11*a*, which are aligned along a line. The nozzles 11*a* of each nozzle row are connected to one of a plurality of (in the illustrated embodiment, six) passages 12, which are defined in the recording head 10. A plurality of (in the illustrated embodiment, six) connecting portions 13 provided on the recording head 10 each have a passage 13*a*. Each of the passages 12 in the recording head 10 communicates with the passage 13*a* of the corresponding one of the connecting portions 13.

A hollow insertion needle 14 projects from the top surface of each connecting portion 13. A passage 14*a* defined in each of the insertion needles 14 communicates with the passage 13*a* of the associated one of the connecting portions 13. A filter 15 that filters ink is arranged between each passage 13*a* and the associated insertion needle 14. A valve unit 16 is secured to each connecting portion 13. In the illustrated embodiment, referring to FIG. 1, six valve units 16 are mounted in the carriage 6 in correspondence with the six colors of ink. The valve units 16 are selectively opened and closed by an actuator 16*a* (see FIG. 3).

Figure 3:
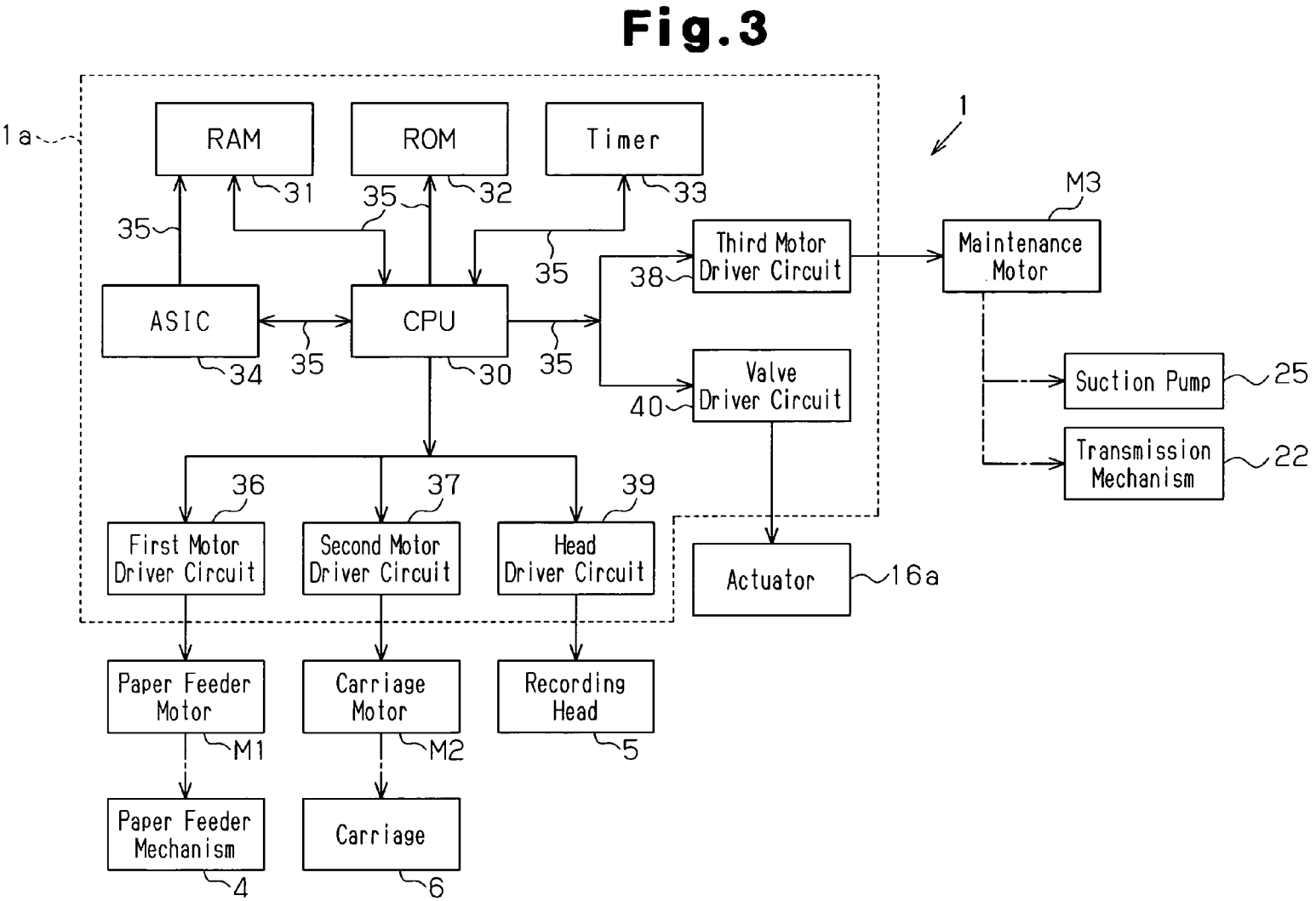
FIG. 3 is a block diagram representing the electric configuration of the printer of FIG. 1.

As shown in FIG. 3, a cartridge holder 17 is provided at the right side in the frame 2. Six cartridges 18, or liquid retainers, are mounted in the cartridge holder 17 removably from the cartridge holder 17. Each of the cartridges 18 retains ink and is connected to the associated one of the valve units 16 through a corresponding one of ink supply lines 19. After having been sent from the cartridge 18 through the corresponding ink supply line 19, the ink is temporarily retained in the associated valve unit 16 and supplied to the recording head 10 through the insertion needle 14, the filter 15, and the passage 13*a* of the connecting portion 13. The ink is then ejected from the recording head 10 as ink droplets through the corresponding nozzles 11*a* through excitement of a non-illustrated piezoelectric element incorporated in the recording head 10.

Referring to FIG. 1, the home position of the carriage 6 is defined at the right side of the platen 3 in the frame 2. A maintenance mechanism 20 is provided at the home position. The maintenance mechanism 20 has a box-like cap 21, which is shown in FIGS. 1 and 2. The cap 21 is raised to an operational position at which the cap 21 contacts the recording head 10 located at the home position by a maintenance motor M3 (see FIG. 3) formed by, for example, a stepping motor and a transmission mechanism 22 (see FIG. 3), which transmits the drive force of the maintenance motor M3. At the home position, the upper end of the cap 21 tightly contacts the nozzle plate 11. The cap 21 thus prevents the ink in the nozzles 11*a* from drying and receives the ink ejected from the nozzles 11*a*.

Referring to FIG. 2, the cap 21 is connected to a non-illustrated waste ink tank through a drainage tube 23. A suction pump 25 is arranged in the drainage tube 23 as a suction unit. In the illustrated embodiment, the suction pump 25 is a tube pump. When the maintenance motor M3 rotates in a forward direction, the suction pump 25 operates to draw fluid (ink and gas) from inside the cap 21 and drain the fluid into the waste ink tank through the drainage tube 23.

When the maintenance motor M3 is rotated in the forward direction with the cap 21 sealing the recording head 10, the space defined by the cap 21 and the recording head 10 is depressurized. As negative pressure accumulates in the space, the fluid is (the ink and the gas are) drawn from the nozzles 11*a* of the recording head 10, and head cleaning is performed.

With the negative pressure accumulated in the cap 21, the maintenance mechanism 20 closes the valve units 16, which are located upstream from the recording head 10, by actuating the actuator 16*a*, as needed, to perform choke cleaning. In the choke cleaning, the interiors of the passages downstream from the valve units 16 and the interior of the recording head 10 are subjected to suction by the suction pump 25. In this manner, negative pressure accumulates in the passages and the recording head 10. Then, the valve units 16 are opened, causing a rapid flow of ink in the passages downstream from the valve units 16 and the interior of the recording head 10. As a result, together with the ink, bubbles and viscous ink are discharged from the passages and the valve units 16 through the nozzles 11*a*. The passages and the recording head 10 are thus filled with the ink free from impurities.

A controller 1*a* of the printer 1 will hereafter be explained with reference to FIG. 3. The controller 1*a* has a CPU 30, a RAM 31, a ROM 32, a timer 33, and an ASIC 34, which form a suction control unit. The CPU 30 is connected to the RAM 31, the ROM 32, the timer 33, and the ASIC 34 through a bus 35. The CPU 30 is connected to a first motor driver circuit 36 that drives the paper feeder motor M1, a second motor driver circuit 37 that drives the carriage motor M2, and a third motor driver circuit 38 that drives the maintenance motor M3 through the bus 35. The CPU 30 outputs drive signals to the motor driver circuits 36, 37 to drive the corresponding motors M1, M2, in accordance with various types of programs stored in the ROM 32. Further, the CPU 30 provides a drive signal to the third motor driver circuit 38 in accordance with a cleaning program stored in the ROM 32. The CPU 30 thus drives the suction pump 25 and the transmission mechanism 22, which selectively raises and lowers the cap 21, through the maintenance motor M3.

The CPU 30 is connected to a head driver circuit 39 that provides a prescribed drive signal to the recording head 10 and a valve driver circuit 40 that drives the actuator 16*a* each through the bus 35. The CPU 30 produces printing data through development and imaging of imaging data input from an external device by the ASIC 34 in accordance with a program stored in the ROM 32. The CPU 30 then outputs a drive signal to the head driver circuit 39 in accordance with the printing data. Further, the CPU 30 sends a drive signal to the valve driver circuit 40 in accordance with the aforementioned cleaning program, thus driving the actuator 16*a*.

Figure 4:
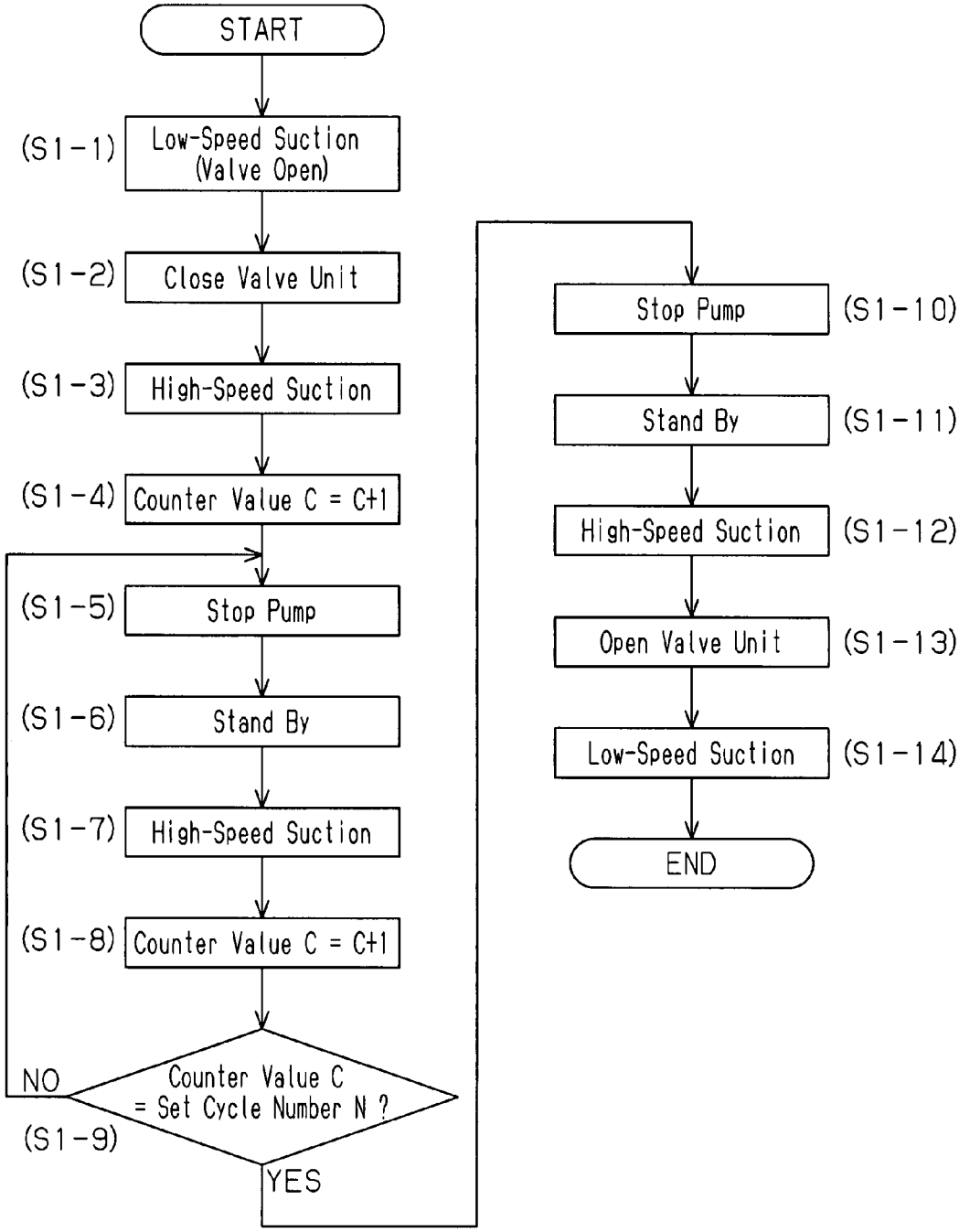
FIG. 4 is a flowchart representing a procedure of the choke cleaning.

Next, a procedure for performing the choke cleaning of the illustrated embodiment will be explained with reference to FIG. 4. The CPU 30 performs the choke cleaning in accordance with the cleaning program stored in the ROM 32 for example, when the cartridges 18 are to be replaced, or after a predetermined time has elapsed since the previous cycle of choke cleaning, or after a defect of printing has been detected by a non-illustrated sensor.

When receiving a start trigger that instructs initiation of the choke cleaning, the CPU 30 determines the position of the carriage 6. When the carriage 6 is not at the home position, the CPU 30 drives the carriage motor M2 through the second motor driver circuit 37 to move the carriage 6 to the home position. Subsequently, the CPU 30 drives the maintenance motor M3 through the third motor driver circuit 38 to send the cap 21 to the operational position. As a result, the upper end of the cap 21 contacts the recording head 10 located at the home position, thus sealing the nozzle plate 11. In this state, the valve units 16 are maintained open in such a manner as to permit the initiation of the choke cleaning.

Then, the CPU 30 operates to rotate the maintenance motor M3 in a forward direction to drive the suction pump 25 to start the choke cleaning. As illustrated in FIG. 4, with the valve units 16 maintained in the open state, the CPU 30 first actuates the suction pump 25 to draw the ink from inside the recording head 10 and the passages upstream from the recording head 10 at a relatively low drainage speed (in step S1-1) as a preliminary suction step. Such suction is referred to as low-speed suction (preliminary suction). The drainage speed corresponds to the amount of the ink drained from the recording head 10 per unit time. In this state, the CPU 30 sends a pulse signal of a first frequency to the maintenance motor M3 through the third motor driver circuit 38. This rotates the maintenance motor M3 by a first rotation number corresponding to the first frequency, and the suction pump 25 runs at a relatively low rotational speed.

For the low-speed suction, the frequency (or the rotational speed of the maintenance motor M3) that permits gradual suction of the ink from the passages from the ink supply lines 19 to the recording head 10 without foaming the ink is determined in advance by tests or the like. The obtained frequency is used as the first frequency that is output to the maintenance motor M3. The first frequency varies in correspondence with the performance of the suction pump 25 and the characteristics of the ink. Through the low-speed suction, small bubbles B1 are collected on the filters 15 below the insertion needles 14.

Figure 5A:
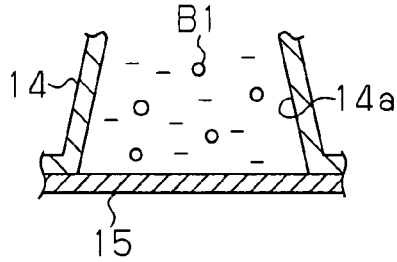
FIG. 5A is an enlarged cross-sectional view showing the vicinity of a filter at an initial stage of the choke cleaning.

FIGS. 5A to 5E are enlarged cross-sectional views showing a portion including the filter 15 and the passage 14*a* of the insertion needle 14 in the vicinity of the filter 15. As illustrated in FIG. 5A, in the low-speed suction, the air that has entered the passage through replacement of the associated cartridge 18 is collected in forms of small bubbles B1 in the space between the walls of the passage 14*a* of the insertion needle 14 and the filter 15. Also, the ink drained through the low-speed suction passes through the small bubbles B1 and the filter 15 and is discharged from the nozzles 11*a* of the recording head 10.

Figure 6:
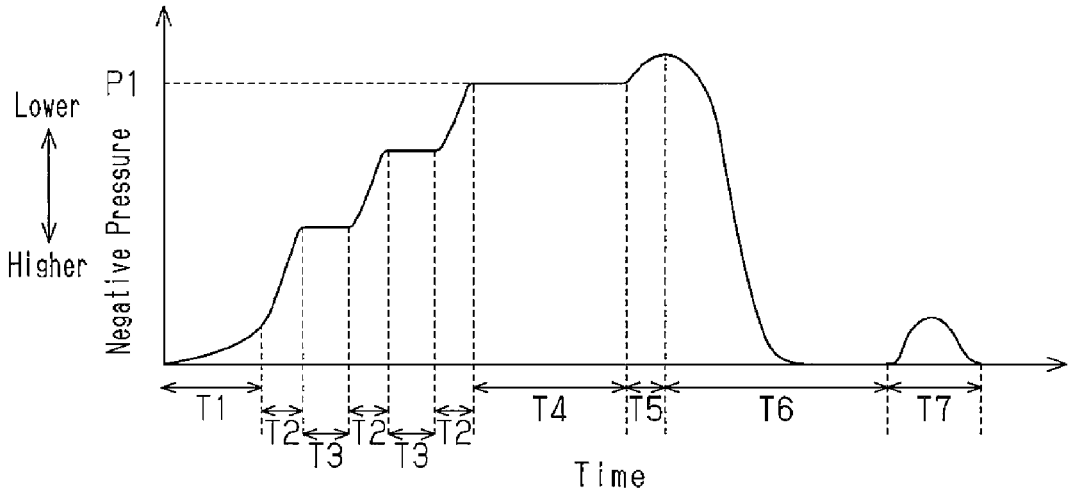
FIG. 6 is a graph representing changes in pressure in an ink passage in the choke cleaning.
Figure 7:
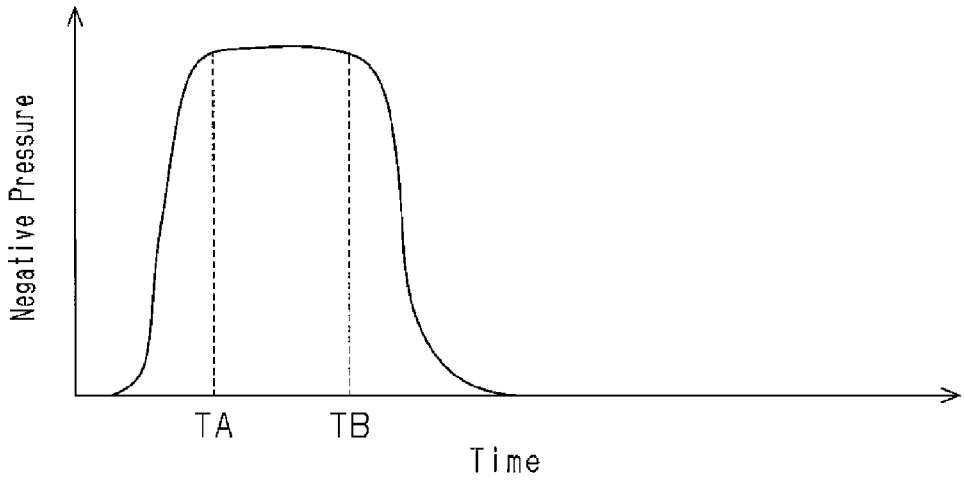
Fig.7 (Prior Art)
FIG. 7 is a graph representing changes in pressure in an ink passage in conventional choke cleaning.

The CPU 30 measures the elapsed time by the timer 33 since initiation of the low-speed suction. The CPU 30 continues the suction until first suction time T1 elapses. Changes in pressure in the vicinity of the insertion needle 14 and the filter 15 as the time elapses are represented by the graph of FIG. 6. With reference to FIG. 6, although the negative pressure is increased by the low-speed suction, accumulation of increased negative pressure does not occur downstream from the valve units 16 since the valve units 16 are maintained open.

Next, the CPU 30 operates the valve driver circuit 40 to drive the actuator 16*a* to close the valve units 16 (in step S1-2). To switch the valve units 16 from an open state to a closed state, the suction pump 25 may be temporarily stopped or, alternatively, the low-speed suction may be continued.

Then, as a main suction step, the CPU 30 operates the valve driver circuit 40 while maintaining the valve units 16 in the closed state, the CPU 30 performs high-speed suction to draw the ink from the side downstream from the valve units 16 at a relatively high drainage speed (in step S1-3). In this state, the CPU 30 outputs a pulse signal of a second frequency to the maintenance motor M3 through the third motor driver circuit 38. The second frequency is higher than the first frequency. The maintenance motor M3 thus rotates by a second rotation number corresponding to the second frequency and the suction pump 25 rotates at a relatively high rotational speed. For the high-speed suction, the frequency that permits accumulation of negative pressure at which choke cleaning can be carried out in the time period suitable as cleaning time at the side downstream from the valve units 16 is determined in advance by tests or the like. The obtained frequency is employed as the second frequency. The time period suitable as the cleaning time is several tens of seconds to several minutes. The CPU 30 continuously performs the high-speed suction for second suction time T2.

As a result, referring to FIG. 6, the interior of each passage 14*a* is quickly depressurized, and the negative pressure increases. This presses the small bubbles B1 on each filter 15 against the filter 15 to flatten the bubbles B1, referring to FIG. 5B. The flattened bubbles B1 (indicated by the chain lines in the drawing) spread in flat shapes and are joined together to form a joint bubble B2. Nonetheless, even after the first cycle of the high-speed suction, the small bubbles B1 still remain on the filter 15.

After continuing the high-speed suction for the second suction time T2, the CPU 30 adds "1" to a count value C memorized in the RAM 31 as a counter, updating the count value C (in step S1-4). In other words, the count value C represents the number of the cycles of high-speed suction. The initial value of the count value C is "0". Therefore, after completing the first cycle of the high-speed suction, the count value C is updated to "1".

Figure 5B:
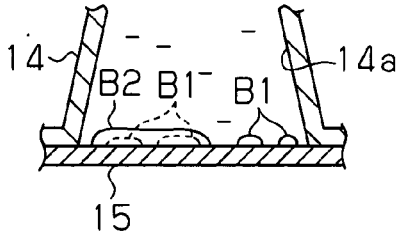
FIG. 5B is an enlarged cross-sectional view showing the vicinity of the filter in a state in which bubbles are joined together in the choke cleaning.
Figure 5C:
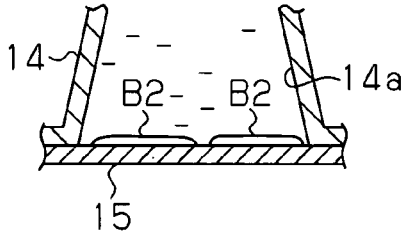
FIG. 5C is an enlarged cross-sectional view showing the vicinity of the filter in a state in which bubbles are joined together in the choke cleaning.
Figure 5D:
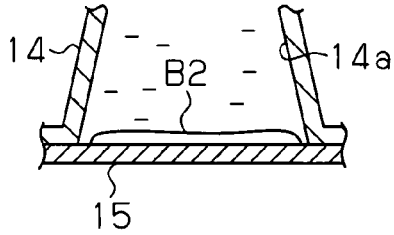
FIG. 5D is an enlarged cross-sectional view showing the vicinity of the filter in a state in which bubbles are joined together in the choke cleaning.

The CPU 30 then operates the third motor driver circuit 38 to stop the suction pump 25 (in step S1-5). The CPU 30 holds the suction pump 25 in the stopped state for suspension time T3 as suction suspension time in accordance with the timer 33 (in step S1-6). This maintains the negative pressure in the passage 14*a* without being changed as illustrated in FIG. 6. Further, the flow speed of the ink passing through the joint bubbles B2 and the small bubbles B1 caught on the filter 15, which are illustrated in FIG. 5B, becomes substantially "0". This makes it easy for the bubbles B1, B2 to move on the filter 15. Therefore, joining of the bubbles B1, B2 is promoted by intermolecular force or the like, thus increasing the sizes of the joint bubbles B2.

Next, when the CPU 30 determines that the suspension time T3 has elapsed, the CPU 30 operates the third motor driver circuit 38 to carry out the high-speed suction for the second suction time T2 (in step S1-7). In this manner, as illustrated in FIG. 6, the negative pressure further accumulates. Also, referring to FIG. 5C, the joint bubbles B2 on each filter 15 receive increased negative pressure and thus spread further flat on the filter 15. Since the sizes of the joint bubbles B2 have increased in the first cycle of the high-speed suction and suspension of the suction, the joint bubbles B2 are easily joined with the small bubbles B1 around the joint bubbles B2 and other joint bubbles B2.

After continuing the high-speed suction for the second suction time T2, the CPU 30 adds "1" to the count value C to update the count value C (in step S1-8). The count value C is thus updated to "2". The CPU 30 then determines whether the count value C has become equal to a predetermined set number of cycles N (in step S1-9). Since the set number of cycles N is "3" in the illustrated embodiment, the CPU 30 determines that the count value C has not become the set number of cycles N (NO in step S1-9) and repeats the procedure of step S1-5.

In step S1-5, the CPU 30 stops the suction pump 25 and stands by for the suspension time T3 (in step S1-6). This promotes further joining of the joint bubbles B2 and the small bubbles B1 on each filter 15. After the suspension time T3 has elapsed, the CPU 30 provides the pulse signal of the second frequency to the maintenance motor M3 through the third motor driver circuit 38 and performs the high-speed suction continuously for the second suction time T2 (in step S1-7). This further increases the negative pressure in the passage 14*a* as shown in FIG. 6. In this manner, by performing suction/suspension in which the high-speed suction and suspension of the suction are repeatedly alternated, the negative pressure in the passage 14*a* increases in a stepped manner as the time elapses, as indicated by the graph of FIG. 6. The negative pressure then reaches a target pressure P1.

In other words, by increasing the negative pressure in the passages downstream from the valve units 16 in a stepped manner, joining of the small bubbles B1 and the joint bubbles B2 on the filters 15 is promoted. Further, by changing the ink flow speed through stopping of the suction pump 25 in the suspension time T3, the joining of the bubbles B1, B2 is promoted.

Also, if the high-speed suction occurs rapidly, pressure loss in the passages may cause a difference between the pressure in the vicinity of the nozzles 11*a* and the pressure immediately below the valve units 16. However, such pressure difference is canceled by stopping the suction pump 25 in the high-speed suction. As a result, sufficiently great negative pressure is accumulated immediately below the valve units 16 and in the vicinities of the filters 15.

After the second suction time T2 has elapsed, the CPU 30 adds "1" to the count value C, updating the current count value C to "3" (in step S1-8). The CPU 30 then compares the count value C with the set number of suction cycles (in step S1-9). If the CPU 30 determines that the count value C has reached the set number of suction cycles N "3" (YES in step S1-9), the CPU 30 performs step S1-10.

The CPU 30 then stops the suction pump 25 through the third motor driver circuit 38 (in step S1-10) and stands by for standby time T4 (in step S1-11). The standby time T4 is longer than the suspension time T3. Specifically, the CPU 30 stands by for the standby time T4 to allow joining of the bubbles B1, B2 on the filters 15. This increases the sizes of the joint bubbles B2, referring to FIG. 5D, and the enlarged joint bubbles B2 spread flat on the filters 15.

After the standby time T4 has elapsed, the CPU 30 operates the third motor driver circuit 38 to output the pulse signal of the second frequency to the maintenance motor M3. The CPU 30 then performs the high-speed suction for third suction time T5 (in step S1-12). As a result, referring to FIG. 6, the negative pressure in the passages downstream from the valve units 16 exceed the target pressure P1, thus further intensely pressing the joint bubbles B2 against the filters 15.

Figure 5E:
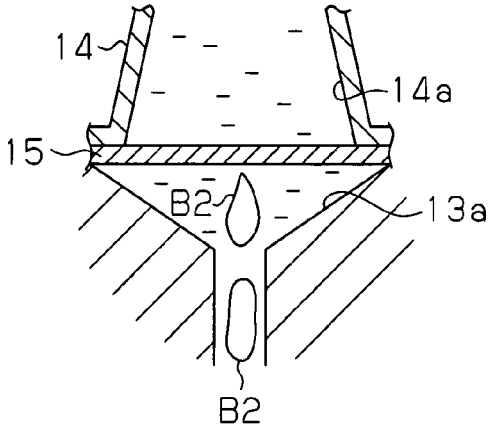
FIG. 5E is an enlarged cross-sectional view showing the vicinity of the filter in a state in which bubbles are discharged through the choke cleaning.

While maintaining the negative pressure in the passages downstream from the valve units 16 at a maximally increased level, the CPU 30 actuates the actuator 16*a* through the valve driver circuit 40 to open the valve units 16, which have been held in the closed state, to carry out drainage (in step S1-13). This causes a rapid ink flow into the passages 14*a* in which the negative pressure have accumulated. Also, as illustrated in FIG. 5E, the joint bubbles B2, which have spread on each filter 15, pass through the filter 15 and reach the passage 13*a* of the associated connecting portion 13. The ink then flow through the passage in the recording head 10 and is discharged into the cap 21 through the nozzles 11*a*.

After a predetermined time T6 has elapsed since opening of the valve units 16, the CPU 30 provides the pulse signal of the first frequency to the maintenance motor M3 through the third motor driver circuit 38 and re-performs the low-speed suction as the drainage (in step S1-14). This cycle of the low-speed suction discharges foamed ink that has been caught in the cap 21 or adhered to the nozzle plate 11 through ink drainage by the choke cleaning. The low-speed suction is continued for fourth suction time T7. After the low-speed suction is finished, the CPU 30 ends the choke cleaning. In this manner, the passages from the valve units 16 to the recording head 10 are filled with ink free from impurities such as bubbles or dust. Further, by this time, the bubbles have been removed from the filters 15.

The illustrated embodiment has the following advantages.

(1) In the choke cleaning, the suction/suspension, in which the high-speed suction and suspension of the suction is alternately repeated, is performed with the valve units 16 upstream from the filters 15, which filter the ink, maintained in the closed state. This allows joining of the bubbles B1, B2 of ink on each of the filters 15. Then, the valve units 16 are opened to drain the bubbles B1, B2, which have developed on the filters 15, from the nozzles 11*a* of the recording head 10, together with the ink. In other words, by repeatedly actuating and stopping the suction pump 25, the pressure in the ink passages is lowered in a stepped manner in such a manner that the bubbles B1, B2 are joined together on the filters 15. Since the joint bubbles B2 are greater in size, the joint bubbles B2 are more easily drained than the small bubbles B1. Therefore, when the ink drainage is carried out, the joint bubbles B2 are easily removed from the filters 15 together with the ink. In this manner, the passages downstream from the valve units 16 are filled with ink free from impurities, and thus the bubble drainage performance is improved.

(2) Prior to the above-described high-speed suction, the ink is drawn from the recording head 10 and the passages upstream from the recording head 10 through the low-speed suction performed with the valve units 16 held in the open state. This collects the small bubbles B1 from the passages onto the filters 15 while preventing the bubbles of ink from becoming smaller in size or dispersing.

(3) After the pressure downstream from the valve units 16 is lowered to the target pressure P1 by the above-described high-speed suction, suction by the suction pump 25 is suspended for the standby time T4. Afterwards, the high-speed suction is repeated. As a result, the joint bubbles B2 that have been pressed against and spread on each filter 15 become further easy to discharge.

(4) By repeating the high-speed suction and suspension of the suction, the pressure in the passages downstream from the valve units 16 is lowered in a stepped manner. After the pressure has reached the target pressure P1, actuation of the suction pump 25 is suspended for the standby time T4, which is longer than the suspension time T3 of the high-speed suction. Therefore, joining of the bubbles B1, B2 occurs in a relatively long time under the increased negative pressure that has reached the target pressure P1.

(5) The low-speed suction is performed after the valve units 16 have been opened to remove the bubbles from the filters 15 together with the ink. This discharges, together with the ink, a small amount of small bubbles that have been generated in the recording head 10 through choke cleaning. Further, the ink is drawn without significantly lowering the pressure in the recording head 10 and the passages by draining the ink through opening of the valve units 16. The meniscuses of the inks in the nozzles 11*a* are thus regulated.

The illustrated embodiment may be modified in the following forms.

The high-speed suction in the second suction time T2 may be performed not less than three times or less than three times.

Depending on the characteristics of ink or the configuration of the recording head 10, the low-speed suction before the high-speed suction or after drainage of the ink may be omitted.

Depending on the characteristics of ink or the configuration of the recording head 10, the rotational speed of the suction pump 25 in the low-speed suction before the high-speed suction may be set to a value equal to the corresponding speed in the high-speed suction.

Depending on the characteristics of ink or the configuration of the recording head 10, the step of suspending actuation of the suction pump 25 for the standby time T4 may be omitted.

Depending on the characteristics of ink or the configuration of the recording head 10, the step of performing the high-speed suction after the standby time T4 may be omitted.

In the illustrated embodiment, the number of the cycles of the high-speed suction is counted. If the count value C reaches the set number N, the suction pump 25 is held in a stopped state for the standby time T4. However, the present invention is not restricted to this. That is, the pressure downstream from the valve units 16 may be measured by a pressure sensor or the like. In this case, when the pressure reaches the target pressure P1, the suction pump 25 is stopped. Further, although the time spent for each of the steps is measured by the timer 33 in the illustrated embodiment, the invention is not restricted to this. Alternatively, when it is determined that the pressure reaches a target pressure in the respective steps using a pressure sensor, the subsequent one of the steps may be started.

The printer 1 may include a pressurization pump or a pressurizing member having a spring as a pressurization mechanism that sends the ink from the cartridges 18 under pressure. The pressurization pump supplies air to the cartridges 18 under pressure to press a flexible member such as an ink pack (not shown). The spring of the pressurizing member presses the flexible member, or the ink pack. When negative pressure accumulates in the passages downstream from the valve units 16 in choke cleaning, the pressurization mechanism may be actuated to supply the ink under pressure. This causes a rapid ink flow in the passages, thus improving the bubble drainage performance.

The valve mechanism is not restricted to the valve unit 16, which is selectively opened and closed by the actuator 16*a*, but may be a valve mechanism (not shown) that is selectively opened and closed through pressure changes. In this case, a pressure chamber is depressurized by stopping a pressurization pump (not shown), which sends the ink from the cartridges 18 to the valve mechanism under pressure. This moves a diaphragm defining the pressure chamber through change of the pressure so that the diaphragm contacts a valve portion, closing the valve mechanism. In this state, as the suction pump 25 is continuously operated, negative pressure accumulates downstream from the valve mechanism, like the illustrated embodiment. Then, the pressurization pump is re-started to supply the ink from the cartridges 18 to the valve mechanism under pressure. The ink thus flows into the pressure chamber, separating the diaphragm from the valve portion, thus opening the valve mechanism.

Although a tube pump is used as the suction pump 25, the suction pump 25 is not restricted to this. The suction pump 25 may be, for example, a gear pump or other types of pumps.

The printer 1 does not necessarily have to be an inkjet type printer but may be, for example, a thermal transfer type printer.

The liquid ejection apparatus is not restricted to the printer 1. The liquid ejection apparatus may be, for example, an apparatus for manufacturing color filters of liquid crystal displays or the like, an apparatus for manufacturing electrodes of organic EL displays or FEDs (surface emitting displays), or an apparatus that ejects a biological organic substance for manufacturing biochips.

What is claimed is:

1. A control method of a liquid ejection apparatus having a liquid ejection head that ejects a liquid from a nozzle, a valve mechanism and a filter being arranged in a liquid passage connected to the liquid ejection head, the filter being provided between the valve mechanism and the liquid ejection head, wherein the method comprises:

performing a suction/suspension in which, with the valve mechanism maintained in a closed state, suction of the liquid from the passage through the nozzle and suspension of the suction are alternately repeated at least twice, whereby accumulating a negative pressure in the passage at a side downstream from the valve mechanism; and performing a drainage in which the valve mechanism is opened so that, using the negative pressure accumulated in the passage, bubbles are removed from the filter through the nozzle together with the liquid.

2. The method according to claim 1, wherein the suction/suspension is performed for promoting joining of the bubbles on the filter.

3. The method according to claim 1, further comprising drawing, after the drainage, the liquid from the passage through the nozzle with the valve mechanism maintained in the open state.

4. A control method of a liquid ejection apparatus having a liquid ejection head that ejects a liquid from a nozzle, a valve mechanism and a filter being arranged in a liquid passage connected to the liquid ejection head, the filter being provided between the valve mechanism and the liquid ejection head, wherein the method comprises:

performing a suction/suspension in which, with the valve mechanism maintained in a closed state, suction of the liquid from the passage through the nozzle and suspension of the suction are alternately repeated, whereby accumulating a negative pressure in the passage at a side downstream from the valve mechanism; and performing a drainage in which the valve mechanism is opened so that, using the negative pressure accumulated in the passage, bubbles are removed from the filter through the nozzle together with the liquid;

performing, prior to the suction/suspension, a preliminary suction in which the liquid is drawn from the passage through the nozzle with the valve mechanism held in an open state.

5. The method according to claim 4, further comprising setting a drainage speed of the liquid in the preliminary suction to a value smaller than the drainage speed in the suction of the suction/suspension.

6. A control method of a liquid ejection apparatus having a liquid ejection head that ejects a liquid from a nozzle, a valve mechanism and a filter being arranged in a liquid passage connected to the liquid ejection head, the filter being provided between the valve mechanism and the liquid ejection head, wherein the method comprises:

performing a suction/suspension in which, with the valve mechanism maintained in a closed state, suction of the liquid from the passage through the nozzle and suspension of the suction are alternately repeated, whereby accumulating a negative pressure in the passage at a side downstream from the valve mechanism; and performing a drainage in which the valve mechanism is opened so that, using the negative pressure accumulated in the passage, bubbles are removed from the filter through the nozzle together with the liquid;

drawing, after the suction/suspension and before the drainage, the liquid from the passage through the nozzle with the valve mechanism held in the closed state.

7. A control method of a liquid ejection apparatus having a liquid ejection head that ejects a liquid from a nozzle, a valve mechanism and a filter being arranged in a liquid passage connected to the liquid ejection head, the filter being provided between the valve mechanism and the liquid ejection head, wherein the method comprises:

performing a suction/suspension in which, with the valve mechanism maintained in a closed state, suction of the liquid from the passage through the nozzle and suspension of the suction are alternately repeated, whereby accumulating a negative pressure in the passage at a side downstream from the valve mechanism; and performing a drainage in which the valve mechanism is opened so that, using the negative pressure accumulated in the passage, bubbles are removed from the filter through the nozzle together with the liquid;

suspending, after the suction/suspension and before the drainage, the suction of the liquid from the passage while maintaining the valve mechanism in the closed state for a time longer than a suction suspension time of the suction/suspension.

8. A liquid ejection apparatus comprising:

a liquid ejection head that ejects a liquid through a nozzle;

a liquid passage connected to the liquid ejection head for supplying the liquid to the liquid ejection head;

a valve mechanism arranged in the liquid passage;

a filter provided in the liquid passage and between the valve mechanism and the liquid ejection head;

a suction unit that draws the liquid from the nozzle; and a suction control unit that controls operations of the valve mechanism and the suction unit, wherein the suction control unit operates the suction unit to perform suction/suspension in which suction of the liquid from the passage through the nozzle and suspension of the suction are alternately repeated at least twice with the valve mechanism held in a closed state, whereby accumulating a negative pressure in the passage at a side downstream from the valve mechanism, and wherein the suction control unit operates to open the valve mechanism after the suction/suspension, whereby performing, using the negative pressure accumulated in the passage, a drainage in which bubbles are removed from the filter through the nozzle together with the liquid.

9. The apparatus according to claim 8, wherein the suction control unit controls the operation of the suction unit in such a manner as to promote joining of the bubbles on the filter through the suction/suspension.

10. The apparatus according to claim 8, wherein, after the drainage, the suction control unit controls the operation of the suction unit in such a manner as to draw the liquid from the passage through the nozzle with the valve mechanism maintained in the open state.

11. A liquid ejection apparatus comprising:

a liquid ejection head that ejects a liquid through a nozzle;

a liquid passage connected to the liquid ejection head for supplying the liquid to the liquid ejection head;

a valve mechanism arranged in the liquid passage;

a filter provided in the liquid passage and between the valve mechanism and the liquid ejection head;

a suction unit that draws the liquid from the nozzle; and a suction control unit that controls operations of the valve mechanism and the suction unit, wherein the suction control unit operates the suction unit to perform suction/suspension in which suction of the liquid from the passage through the nozzle and suspension of the suction are alternately repeated with the valve mechanism held in a closed state, whereby accumulating a negative pressure in the passage at a side downstream from the valve mechanism, and wherein the suction control unit operates to open the valve mechanism after the suction/suspension, whereby performing, using the negative pressure accumulated in the passage, a drainage in which bubbles are removed from the filter through the nozzle together with the liquid, wherein the suction control unit operates the suction unit to perform a preliminary suction in which, prior to the suction/suspension, the liquid is drawn from the passage through the nozzle with the valve mechanism held in an open state.

12. The apparatus according to claim 11, wherein the suction control unit controls the operation of the suction unit in such a manner that a drainage speed of the liquid in the preliminary suction becomes smaller than the drainage speed in the suction of the suction/suspension.

13. A liquid ejection apparatus comprising:

a liquid ejection head that ejects a liquid through a nozzle;

a liquid passage connected to the liquid ejection head for supplying the liquid to the liquid ejection head;

a valve mechanism arranged in the liquid passage;

a filter provided in the liquid passage and between the valve mechanism and the liquid ejection head;

a suction unit that draws the liquid from the nozzle; and a suction control unit that controls operations of the valve mechanism and the suction unit, wherein the suction control unit operates the suction unit to perform suction/suspension in which suction of the liquid from the passage through the nozzle and suspension of the suction are alternately repeated with the valve mechanism held in a closed state, whereby accumulating a negative pressure in the passage at a side downstream from the valve mechanism, and wherein the suction control unit operates to open the valve mechanism after the suction/suspension, whereby performing, using the negative pressure accumulated in the passage, a drainage in which bubbles are removed from the filter through the nozzle together with the liquid , wherein, after the suction/suspension and before the drainage, the suction control unit controls the operation of the suction unit in such a manner as to further draw the liquid from the passage through the nozzle with the valve mechanism held in the closed state.

14. A liquid ejection apparatus comprising:

a liquid ejection head that ejects a liquid through a nozzle;

a liquid passage connected to the liquid ejection head for supplying the liquid to the liquid ejection head;

a valve mechanism arranged in the liquid passage;

a filter provided in the liquid passage and between the valve mechanism and the liquid ejection head;

a suction unit that draws the liquid from the nozzle; and a suction control unit that controls operations of the valve mechanism and the suction unit, wherein the suction control unit operates the suction unit to perform suction/suspension in which suction of the liquid from the passage through the nozzle and suspension of the suction are alternately repeated with the valve mechanism held in a closed state, whereby accumulating a negative pressure in the passage at a side downstream from the valve mechanism, and wherein the suction control unit operates to open the valve mechanism after the suction/suspension, whereby performing, using the negative pressure accumulated in the passage, a drainage in which bubbles are removed from the filter through the nozzle together with the liquid, wherein, after the suction/suspension and before the drainage, the suction control unit controls the operation of the suction unit in such a manner as to suspend the suction of the liquid from the passage while maintaining the valve mechanism in the closed state for a time longer than a suction suspension time of the suction/suspension.

* * * * *